US012465115B2

(12) United States Patent
Dyen et al.

(10) Patent No.: US 12,465,115 B2
(45) Date of Patent: Nov. 11, 2025

(54) COMPOSITE SHOE PLATE HAVING A PROGRESSIVE LONGITUDINAL BENDING STIFFNESS CHARACTERISTIC

(71) Applicant: Arris Composites Inc., Berkeley, CA (US)

(72) Inventors: Arnaud Dyen, San Francisco, CA (US); Erick Davidson, Piedmont, CA (US); Andrew T. Brady, El Cerrito, CA (US)

(73) Assignee: Arris Composites Inc., Berkeley, CA (US)

( * ) Notice: Subject to any disclaimer, the term of this patent is extended or adjusted under 35 U.S.C. 154(b) by 0 days.

(21) Appl. No.: 18/517,985

(22) Filed: Nov. 22, 2023

(65) Prior Publication Data

US 2024/0172838 A1 May 30, 2024

Related U.S. Application Data

(60) Provisional application No. 63/428,100, filed on Nov. 27, 2022.

(51) Int. Cl.

*A43B 13/18* (2006.01)
*A43B 13/02* (2022.01)
*A43B 13/12* (2006.01)

(52) U.S. Cl.

CPC ..... *A43B 13/186* (2013.01); *A43B 13/026* (2013.01); *A43B 13/125* (2013.01)

(58) Field of Classification Search

CPC ... A43B 13/186; A43B 13/026; A43B 13/125; A43B 13/141

See application file for complete search history.

(56) References Cited

U.S. PATENT DOCUMENTS

| | | | | |
|---|---|---|---|---|
| 2,041,901 | A * | 5/1936 | Cavanagh | A43B 13/38 12/146 BP |
| 5,709,954 | A * | 1/1998 | Lyden | A43B 23/027 36/31 |
| 10,485,294 | B2 | 11/2019 | Schneider | |
| 10,660,400 | B2 * | 5/2020 | Baucom | A43B 13/141 |
| 2003/0131504 | A1 * | 7/2003 | Bock | A43B 19/005 36/44 |
| 2006/0277793 | A1 * | 12/2006 | Hardy | A43B 13/186 36/28 |
| 2008/0229617 | A1 * | 9/2008 | Johnson | A43B 3/0057 36/102 |
| 2010/0299965 | A1 * | 12/2010 | Avar | A43B 5/06 36/102 |
| 2012/0174439 | A1 * | 7/2012 | O'Connor | A43B 5/08 36/11.5 |
| 2013/0000153 | A1 * | 1/2013 | Weidman | A43B 13/26 36/103 |
| 2014/0259744 | A1 * | 9/2014 | Cooper | A43B 3/0057 36/28 |
| 2015/0173456 | A1 * | 6/2015 | Rushbrook | A43B 13/181 36/25 R |

(Continued)

*Primary Examiner* — Bao-Thieu L Nguyen
(74) *Attorney, Agent, or Firm* — Kaplan Breyer Schwarz, LLP

(57) ABSTRACT

A shoe plate, which is integrated into footwear, is provided. The shoe plate is relatively less stiff up to a threshold degree of bending, at which point the shoe plate transitions to regime in which the shoe plate becomes relatively stiffer. This occurs at a location proximal to the forefoot of the shoe plate.

17 Claims, 7 Drawing Sheets

(56) References Cited

U.S. PATENT DOCUMENTS

| | | | | |
|---|---|---|---|---|
| 2016/0051012 | A1* | 2/2016 | Avar | A43B 13/226<br>36/103 |
| 2016/0219973 | A1* | 8/2016 | Cheney | A43B 13/38 |
| 2017/0079376 | A1* | 3/2017 | Bunnell | A43B 13/188 |
| 2017/0127755 | A1* | 5/2017 | Bunnell | A43B 13/122 |
| 2017/0224051 | A1* | 8/2017 | Bunnell | A43B 13/14 |
| 2018/0055143 | A1* | 3/2018 | Baucom | A43B 13/183 |
| 2018/0295935 | A1* | 10/2018 | Giandolini | A43B 13/141 |
| 2018/0332924 | A1* | 11/2018 | Bailey | A43B 13/186 |
| 2021/0378360 | A1 | 12/2021 | Escowitz et al. | |
| 2022/0087359 | A1* | 3/2022 | Sakamoto | A43B 7/087 |
| 2022/0408876 | A1* | 12/2022 | Moehring | A43B 13/04 |
| 2024/0365926 | A1* | 11/2024 | Auyang | A43B 13/186 |

* cited by examiner 901
922
106
102
924
A
A
104'
102

102
922
106
924
102

102
922
106
924
102

901
922
106
924
B
B

1030
M
M 106
1101
922'
C
C
1134
924'
1132
104"
102

1101
922'
106
924'
1132
1134
102

102
1132
924'
106
922'
1134
102

COMPOSITE SHOE PLATE HAVING A PROGRESSIVE LONGITUDINAL BENDING STIFFNESS CHARACTERISTIC

STATEMENT OF RELATED CASES

This specification claims priority to U.S. Pat. App. 63/428,100, filed Nov. 27, 2022, and which is incorporated by reference herein.

FIELD OF THE INVENTION

The present invention relates to footwear incorporating a fiber-composite shoe plates.

BACKGROUND

"Turf toe," which is a sprain of the main joint of the big toe, is a common field-sports injury. This injury occurs when the toe is forcibly bent upwards into hyperextension, such as when pushing off into a sprint. This injury has become more prevalent with the rise of artificial-turf playing fields, since these surfaces are less shock absorbent than grass, and do not yield to the same degree as grass. A trend towards softer, more flexible athletic shoes for artificial surfaces compounds the problem, providing more agility but less stability for the forefoot.

This issue has been addressed in several ways. For example, carbon-fiber shoe inserts are available that include a semi-rigid or rigid extension called a "Morton's extension." This provides rigidity for the joint of the big toe, preventing hyperextension. And some footwear includes toe rocker soles in which the sole curves upwards towards the toes. This reduces pressure under the ball of the foot, reducing motion in the toe.

There are drawbacks to these approaches for preventing turf toe and other big-toe injuries. Rigid inserts are associated with some loss in flexibility and therefore impact athletic performance. Rocker-style shoes alter the wearer's gait, which can increase the risk of falls, particularly in older users.

A need therefore remains for an improved approach for addressing big-toe injuries that occur during participation in sports.

SUMMARY

Embodiments of the invention address the aforementioned drawbacks of existing footwear inserts. Some embodiments of the invention provide a fiber-composite shoe plate having a progressive longitudinal bending stiffness (PLBS) characteristic. The defining attribute of the PLBS characteristic is that the resistance to bending (i.e., stiffness) of the shoe plate increases once a threshold amount of bending is reached. The shoe plate is not a separate aftermarket "insert" that is added to footwear by a wearer; rather, it is integrated into footwear, typically in the midsole, by the footwear manufacturer.

In the illustrative embodiment, a shoe plate having a PLBS characteristic has an open-lattice structure defined by a plurality of intersecting ribs formed from resin and fiber. In some other embodiments, the shoe plate is solid; that is, it does not have an open lattice structure (yet it is still formed from resin and fiber).

The forefoot of the shoe plate (i.e., near to the location of a wearer's metatarsal-phalangeal joint) is physically adapted to provide the PLBS characteristic. In the illustrative embodiment, one or more of the ribs are physically adapted to provide an increase in the stiffness of forefoot of the shoe plate upon reaching (or exceeding) a threshold degree of bending. This threshold may vary with use case, but will typically occur at a bend angle in the range of about 10° to about 60°, wherein a maximum bend angle for toe-off during sprinting is about 75°.

Embodiments of the invention employ several approaches to achieving the PLBS characteristic. One approach relies on structural interference. For this approach, features at the forefoot of the shoe plate are arranged so that once threshold bending/deflection is attained, further deflection cause the features to contact or otherwise interfere with one another. This interference increases the resistance to further bending, as compared to the resistance presented by the shoe plate before reaching threshold deflection.

Another approach is based on the anisotropic properties of fiber-composite materials. Consider that for an identical geometry, a composite beam having its fibers aligned in the force-loading direction will be significantly stiffer than a beam whose fibers are not so aligned (i.e., the fibers have an "off-axis" alignment). In accordance with some embodiments of the invention, this property is utilized to create the PLBS characteristic. In some such embodiments, certain ribs of the shoe plate have a nominal (i.e., prior to bending) off-axis alignment with respect to the force-loading direction of the shoe plate. (In this context, the force-loading direction is more-or-less aligned with the longitudinal axis of the shoe plate). In the off-axis orientation, the ribs provide less of a contribution to the overall stiffness of the shoe plate than if they were aligned with the force-loading direction. As the shoe plate reaches threshold deflection, these off-axis ribs (and the fibers therein), as a consequence of their shape and positioning, deform to more closely align with the force-loading direction. This increases the stiffness of the shoe plate, providing greater resistance to further deflection.

In yet a third approach, certain material properties, such as bulk modulus, are used to create the PLBS characteristic. In an embodiment utilizing this approach, a material is disposed in channels that are formed in or on the shoe plate at the forefoot thereof. As the shoe plate deflects, the material compresses. With increasing deflection, and hence increasing compression of the material, the material exhibits an increasing resistance to further compression. In these embodiments, there is no structural contact/interference as in the approach referenced above.

These approaches can be combined to fine tune aspects of the stiffness profile, such as the transition between relatively less stiff and relatively more stiff regimes, the magnitude and profile of the stiffness after the threshold is reached, etc.

In some embodiments, the invention provides an article comprising a shoe plate, wherein the shoe plate consists essentially of a resin and fibers, and wherein the shoe plate has physical adaptation that provides a progressive longitudinal bending stiffness characteristic at a forefoot region of the shoe plate, wherein a stiffness of the shoe plate at the forefoot region transitions from relatively less stiff to relatively stiffer at or above a threshold bend angle.

In some other embodiments, the inventions provides an article comprising a shoe plate, wherein the shoe plate comprises an open-lattice structure defined by a plurality of ribs consisting essentially of a resin and fibers, and wherein the shoe plate has physical adaptation that provides a progressive longitudinal bending stiffness characteristic at a forefoot region of the shoe plate, wherein a stiffness of the shoe plate at the forefoot region transitions from relatively less stiff to relatively stiffer at or above a threshold bend angle.

A number of other embodiments of the invention are depicted in the appended drawings and described in the Detailed Description of this specification.

DETAILED DESCRIPTION

Figure 1A:
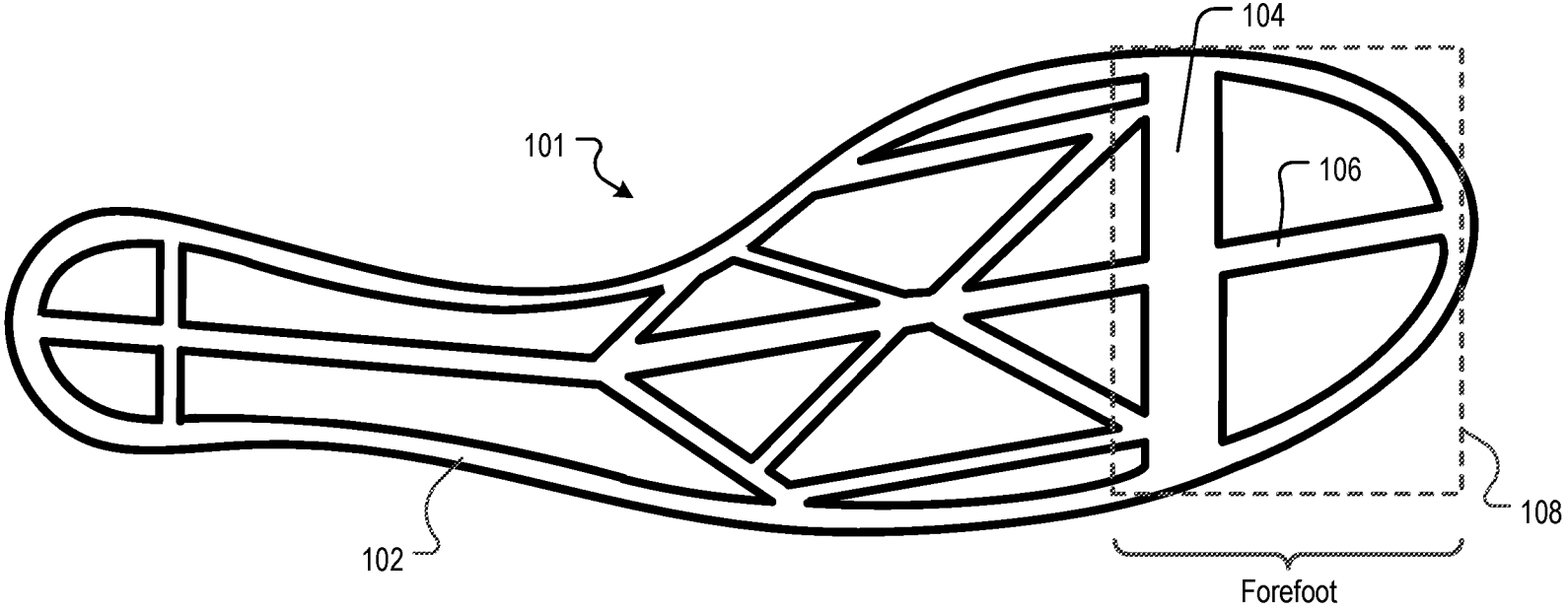
FIG. 1A depicts a shoe plate comprising a physical adaptation that provides a progressive longitudinal bending stiffness (PLBS) characteristic, in accordance with the present teachings.

Definitions. The following terms are defined for use in this description and the appended claims:

"Tow" means a bundle of fibers (i.e., fiber bundle), and those terms are used interchangeably herein unless otherwise specified. Tows are typically available with fibers numbering in the thousands: a 1K tow, 4K tow, 8K tow, etc.

"Towpreg" means a fiber bundle (i.e., a tow) that is impregnated with resin.

"Preform" means a bundle of plural, co-aligned, same-length, resin-wetted fibers. The bundle is often (but not necessarily) sourced from a long length of towpreg. That is, the bundle is a segment of towpreg that has been cut to a desired size and, in many cases, is shaped (e.g., bent, twisted, etc.) to a specific form, as appropriate for the specific part being molded. The cross section of the preform, and the fiber bundle from which it is sourced typically has an aspect ratio (width-to-thickness) of about 1, and usually has a circular or oval cross section. Nearly all fibers in a given preform have the same length (i.e., the length of the preform) and, as previously noted, are unidirectionally aligned. Applicant's use of the term "preform" means a fiber-bundle-based preform, and explicitly excludes any size of shaped pieces of: (i) tape (typically having an aspect ratio—cross section, as above—of between about 10 to about 30), (ii) sheets of fiber, and (iii) laminates.

"Partial consolidation" means, in the molding/forming arts, that in a grouping of fibers/resin, void space is not removed to the extent required for a final part. As an approximation, one to two orders of magnitude more pressure is required for full consolidation versus partial consolidation. As a further very rough generalization, to consolidate fiber composite material to about 80 percent of full consolidation requires only 20 percent of the pressure required to obtain full consolidation.

"Preform Charge" means an assemblage of preforms that are at least loosely bound together (i.e., "tacked") so as to maintain their position relative to one another. Preform charges can contain a minor amount of fiber in form factors other than fiber bundles, and can contain various inserts, passive or active. As compared to a final part, in which fibers/resin are fully consolidated, in a preform charge, the preforms are only partially consolidated (lacking sufficient pressure and possibly even sufficient temperature for full consolidation). By way of example, whereas applicant's compression-molding processes are often conducted at thousands of psi, the downward pressure applied to the preforms to create a preform charge in accordance with the present teachings is typically in the range of about 10 psi to about 100 psi. Thus, voids remain in a preform charge, and, as such, the preform charge cannot be used as a finished part.

"Layup" means an assemblage of preforms that are added to a mold cavity but not bound together prior to molding, in contrast to the preform charge.

"Compression molding" is a molding process that involves the application of heat and pressure to feed constituents for a period of time. For applicant's processes, the applied pressure is usually in the range of about 1000 psi to about 3000 psi, and temperature, which is a function of the particular resin being used, is typically in the range of about 150° C. to about 400° C. Once the applied heat has increased the temperature of the resin above its melt temperature, it is no longer solid. The resin will then conform to the mold geometry via the applied pressure. Elevated pressure and temperature are typically maintained for a few minutes. Thereafter, the mold is removed from the source of pressure and is cooled. Once cooled, a finished part is removed from the mold.

"Footwear component" means an element, typically structural, of an item of footwear. For example, an outsole, a midsole, a heel counter, and an upper, among other elements, are all "footwear components."

"Progressive Longitudinal Bending Stiffness (PLBS) Profile/Characteristic" means that the bending stiffness of a shoe plate, or a midsole incorporating the shoe plate, or footwear incorporating the shoe plate, increases when a threshold amount of bending (along the longitudinal direction of the shoe plate/midsole/footwear) occurs. That is, the slope of the load-versus-displacement relation for the shoe plate transitions from a relatively lesser slope to a relatively greater slope at the threshold. The threshold occurs well within the normal range of bending that occurs during toe-off; typically, once the shoe plate bends by an amount in the range of between about 10 to about 60 degrees, as a function of use case.

"About" or "Substantially" means +/−20% with respect to a stated figure or nominal value.

Additional definitions may be provided, in context, elsewhere in this specification. All patents and published patent applications referenced in this disclosure are incorporated by reference herein.

Figure 1B:
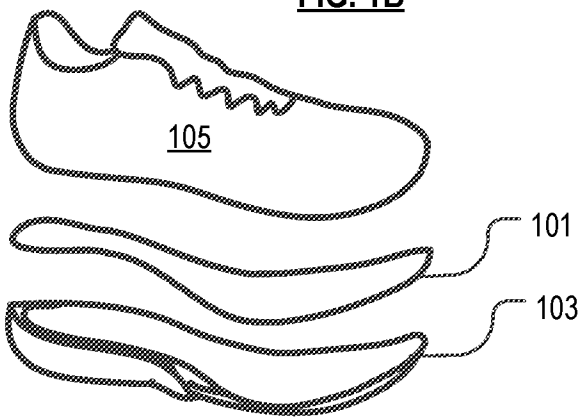
FIG. 1B depicts an exploded view of footwear incorporating the shoe plate of FIG. 1A.

FIG. 1A depicts shoe plate 101 in accordance with the present teachings. Shoe plate 101 has an open-lattice structure defined by a plurality of intersecting ribs, such as internal ribs 104 and 106, and perimeter rib 102. The perimeter of shoe plate 101 defines a shape similar to that of a human foot, and the side profile, better seen in FIG. 1B, is "arched." To form an item of footwear, such as a sneaker, shoe plate 101 is typically disposed within or on midsole 103, which is then combined with upper 105 and other conventional footwear components (not depicted).

Shoe plate 101 is a fiber composite; that is, it is formed from a polymer resin, such as a thermoplastic resin, and a plurality of fibers. Any of a variety of resins and fibers may be used to form shoe plate 101. Typical, but non-limiting examples of thermoplastic resins for molding shoe plate 101 include polycarbonate and nylon (polyamide). Typical, but non-limiting examples of fibers for molding the shoe plate include glass fibers (for flexibility) and carbon fibers (for stiffness). Although one type of resin is typically used throughout shoe plate 101, more than one type of fiber may be used, as best suits the properties (e.g., flexibility or stiffness, etc.) required at a given region of the shoe plate. A typical range for the fiber volume fraction (i.e., the percentage of fiber volume in the entire volume of the composite material) is about 40 to 50 percent. For a typical use case, shoe plate 101 has a thickness in a range of about 2 to 4 millimeters (mm); that is, perimeter rib 102 and the internal ribs, such as ribs 104 and 106, have a thickness in the aforementioned range.

In accordance with the present teachings, shoe plate 101 is physically adapted to provide a PLBS characteristic when in use; namely, when the shoe plate deflects/bends near the forefoot, such as during "push off" of the gait cycle. To that end, physical adaptation 108 for providing that characteristic is sited at the forefoot region of shoe plate 101.

With the exception of physical adaptation 108 for providing the PLBS characteristic, of which a number of embodiments are presented herein, the construction and fabrication of the shoe plates disclosed herein are consistent with the teachings provided in US Pub Pat App US2021/0378360, which is incorporated by reference herein.

Figure 2A:
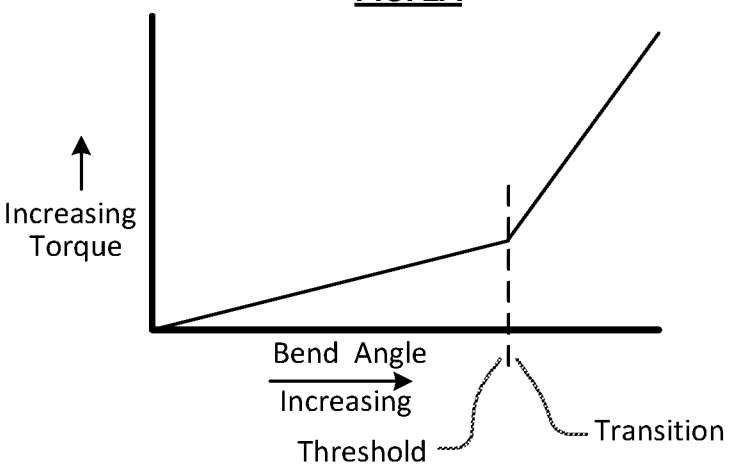
FIG. 2A depicts a load-versus-displacement relation for a first group of shoe plates in accordance with the present teachings.
Figure 2B:
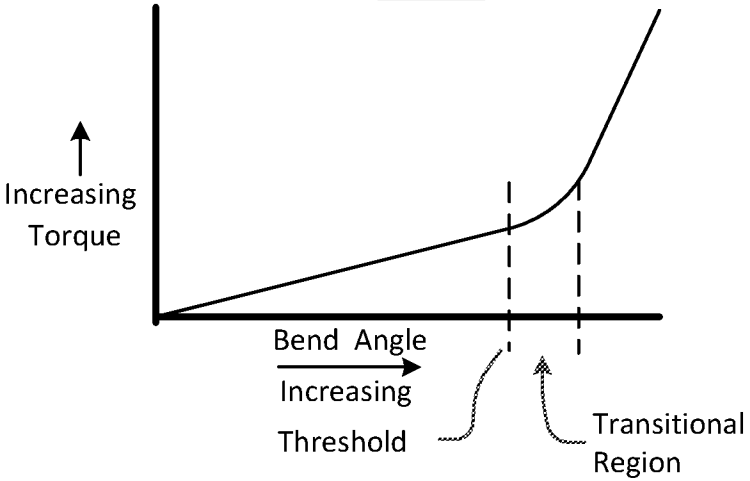
FIG. 2B depicts a load-versus-displacement relation for a second group of shoe plates in accordance with the present teachings.
Figure 2C:
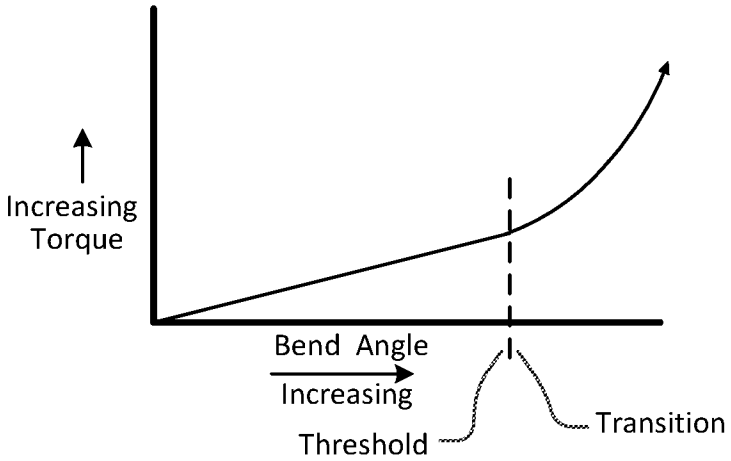
FIG. 2C depicts a load-versus-displacement relation for a third group of shoe plates in accordance with the present teachings.

The response of shoe plate 101, in particular the PLBS characteristic, is depicted by the load (torque) versus displacement (bending) relations depicted in FIGS. 2A through 2C. The slope of the load versus displacement relation is "stiffness." The stiffness profile at and beyond threshold bending may be varied based on the manner in which the PLBS characteristic is implemented. For example, implementation details may affect the transition (e.g., discrete/immediate, as depicted in FIG. 2A, or gradual, as depicted in FIG. 2B). The implementation details may affect the magnitude of the stiffness after the threshold has been reached. And the implementation details may affect the shape of the load-versus-displacement relation post threshold (e.g., linear, as depicted in FIGS. 2A, 2B versus non-linear, as depicted in FIG. 2C).

Structural Interference. In some embodiments, the PLBS characteristic of the shoe plate is implemented via one or more features that provide structural interference at threshold bending. Several non-limiting embodiments of shoe plates utilizing such interference are described below. It is notable that the various embodiments depicted herein are based on a shoe plate having an open-lattice structure defined by a plurality of interconnecting ribs. In some other embodiments, the shoe plate has a continuous surface, rather than the open-lattice structure of the illustrative embodiments. The various physical adaptations described below can readily be adapted to use with a shoe plate having a continuous surface. It is within the capabilities of those skilled in the art, in conjunction with this specification, to incorporate the physical adaptations described below to a shoe plate having a continuous surface.

Figure 3A:
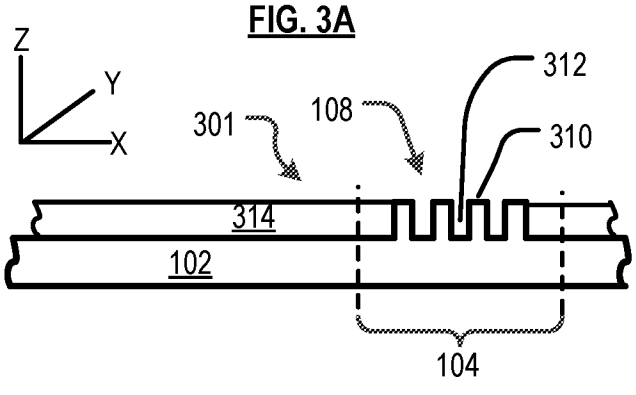
FIG. 3A depicts a side view of a portion of a shoe plate in accordance with FIG. 1A, the shoe plate having a physical adaption that provides a PLBS characteristic, wherein the shoe plate is shown in an undeflected state.

FIG. 3A depicts a side view of a portion of shoe plate 301 in accordance with the present teachings. The portion shown in FIG. 3A is near the forefoot of shoe plate 301, proximate to rib 104 (see FIG. 1A). FIG. 3A shows a portion of perimeter rib 102, a layer 314 of solid foam that is disposed on the ribs (on perimeter rib 102 as well as the internal ribs, not depicted). In this embodiment, physical adaptation 108 is a plurality of ridges 310 that extends from the upper surface of rib 104, and which extends onto perimeter rib 102. Adjacent ridges 310 are separated by channel 312. Ridges 310, like rib 104, have a transverse orientation, extending across the width of shoe plate 301. (See FIG. 3C.) Since there will be additional layers of material above shoe plate 301, layer 314 prevents the any collapse of ribs 310 prior to threshold bending of shoe plate 301.

Ridges 310 are situated in the region of shoe plate 301 at which the PLBS characteristic is required, such as to prevent toe injuries. Specifically, ridges 310 are situated in the forefoot of shoe plate 101 so that when footwear incorporating the shoe plate is being worn, the ridges are proximate to the wearer's metatarsal-phalangeal joint. In some embodiments, ridges 310 are additionally present along the portion of rib 106 that is located forward of rib 104 (see FIG. 1A). Moreover, to the extent that ridges extend from the rib 104 to perimeter rib 102, additional ridges may be formed on perimeter rib 102, forward of rib 104.

The initial amount of stiffness (i.e., prior to threshold bending) that is imparted to footwear by shoe plate 301 is a function of the geometry of the shoe plate (such as the layout of the ribs), as well as the composition, width, and thickness of the ribs. Aspects of rib composition impacting this nominal stiffness include, among any others: (1) fiber type, (2) resin type, (3) fiber alignment, (4) fiber volume fraction, and (5) the presence of any (optional) inserts.

Figure 3B:
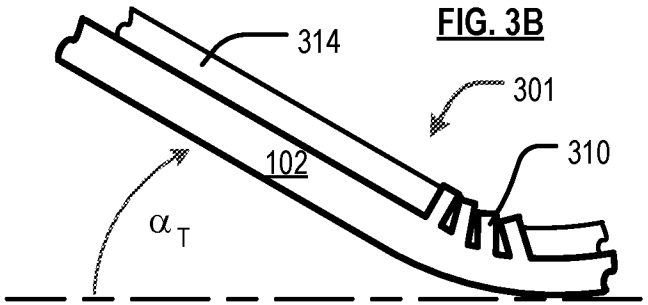
FIG. 3B depicts the partial shoe plate of FIG. 3A shown at threshold deflection.

FIG. 3B depicts shoe plate 301 bending, such as when a wearer of an item of footwear incorporating the shoe plate leans forward and pushes off, such as to sprint. As depicted, most deflection occurs forward of the ball of the wearer's foot. At a threshold bend angle, $\alpha_\tau$, ridges 310 contact one another, creating increased resistance to further bending. Threshold bending occurs at an angle that is typically in a range of about 10° to 60°, wherein the precise threshold bend angle $\alpha_\tau$ may vary based on use case (e.g., a shoe primarily intended for sprinting versus jumping, etc.). Because ridges 310 will impact one another at substantially the same time, the transition between the two stiffness regimes tends to be relatively discrete, similar to what is depicted in FIG. 2A.

The threshold bend angle $\alpha_\tau$ at which shoe plate transitions between the stiffness regimes (i.e., initial/nominal stiffness to increased stiffness) is based on the width ("x" direction in FIG. 3A) and height ("z" direction in FIG. 3A) of ridges 310, and the gap (the size of channel 312) between ridges 310. Threshold bend angle $\alpha_\tau$ increases with: an increase in that width, a decrease in that height, and an increase in the size of the gap.

The stiffness of the greater-stiffness regime of shoe plate 301 is dictated by the composition (fiber type, resin type, fiber alignment, and fiber volume fraction) of ridges 310, the width of ridges 310, and to a lesser extent, the height of ridges 310. As to fiber alignment, the greater the degree of alignment of the fibers in ridge 310 with the bending direction (i.e., along the longitudinal axis of the shoe plate), the stiffer the shoe plate (i.e., more resistance to bending).

Figure 3C:
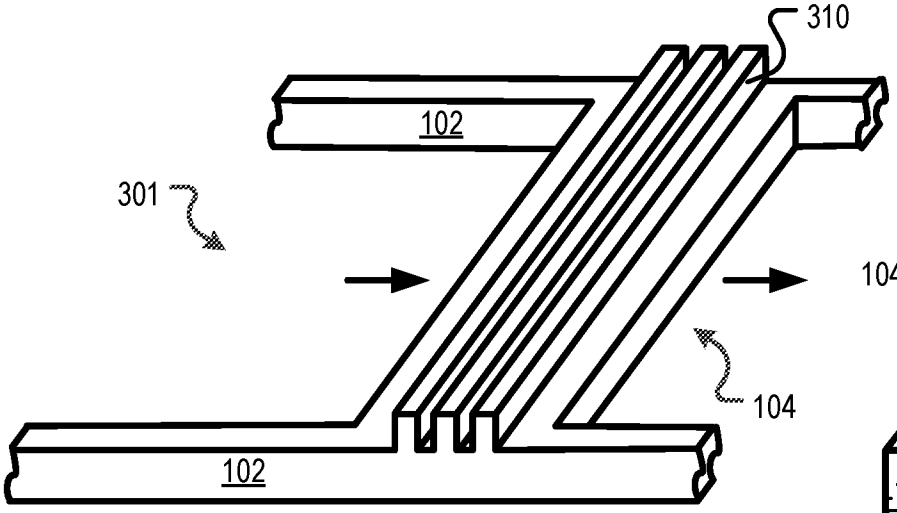
FIG. 3C depicts a perspective view of the portion of the shoe plate of FIG. 3A

FIG. 3C depicts a perspective view of the portion of shoe plate 301 depicted in FIG. 3A. Ridges 310 extend upward from the upper surface of rib 104. In the embodiment depicted in FIGS. 3A-3C, ridges 310 extend onto perimeter rib 102. The arrows show the fiber alignment in rib 104 (and perimeter 102 in the region pictured in FIG. 3C). Layer 314 (FIG. 3A) is omitted for clarity of illustration.

For embodiments in which the shoe plate comprises a continuous surface (as opposed to an open lattice structure), a plurality of ridges similar to ridges 310 can be formed on the surface of the shoe plate proximate to the forefoot region. These ridges would contact one another at the threshold bend angle, as do ridges 310, thereby providing the PLBS characteristic.

Figure 4A:
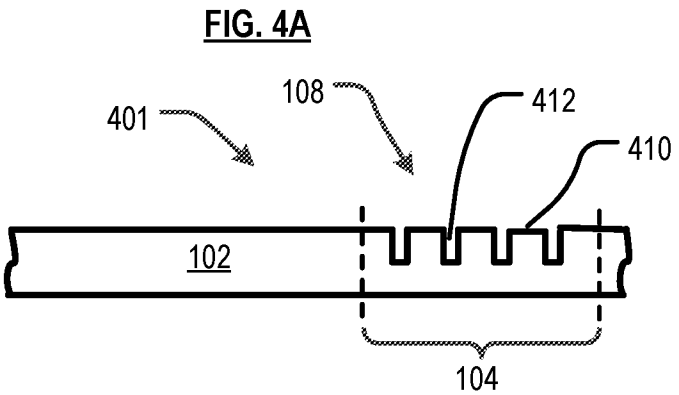
FIG. 4A depicts a portion of a shoe plate in accordance with FIG. 1A, the shoe plate having a physical adaption that provides a PLBS characteristic, wherein the shoe plate is shown in an undeflected state.

FIG. 4A depicts a side view of a portion of shoe plate 401 in accordance with the present teachings. The portion shown in FIG. 4A is near the forefoot of plate 401, near rib 104. FIG. 4A shows a portion of perimeter rib 102, and physical adaptation 108, which in this embodiment is a plurality of recessed ridges 410 formed in rib 104, wherein neighboring recessed ridges 410 are separated by channel 412. The recessed ridges 410, like ridges 310, have a transverse orientation, extending across the width of shoe plate 401. (See, FIG. 4C.)

Recessed ridges 410 are situated in the same region as ridges 310, so as to provide the PLBS characteristic at a location that will prevent toe injuries. In some embodiments, recessed ridges 410 are additionally present along the portion of rib 106 that is located forward of rib 104 (see FIG. 1A).

Like shoe plate 301, the initial amount of stiffness (prior to threshold bending) that is imparted to footwear by shoe plate 401 is a function of the geometry (lattice arrangement of ribs) of the shoe plate, as well as the composition, thickness, and width of the ribs. Aspects of rib composition impacting nominal stiffness include, among any others: (1) fiber type, (2) resin type, (3) fiber alignment, (4) fiber volume fraction, and (5) the presence of any (optional) inserts.

Figure 4B:
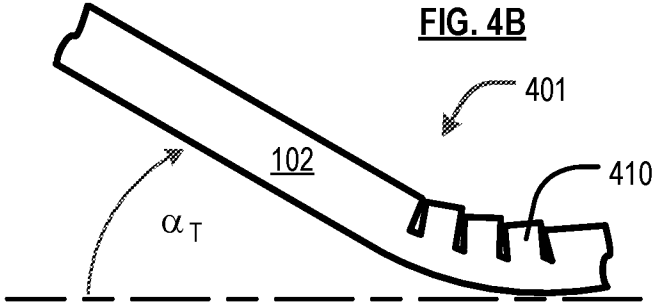
FIG. 4B depicts the shoe plate of FIG. 4A shown at threshold deflection.

FIG. 4B depicts shoe plate 401 bending, such as when a wearer of an item of footwear incorporating the shoe plate leans forward and pushes off, such as to sprint. As depicted, most deflection occurs forward of the ball of the wearer's foot. Recessed ridges 410 begin pressing into one another at the threshold bending angle, $\alpha_\tau$, creating increased resistance to further bending. Like the embodiment of FIG. 3A, threshold bend angle $\alpha_\tau$ is typically in a range of about 10° to 60°, wherein the precise angle may vary based on use case (e.g., sprinting, jumping, etc.). Because recessed ridges 410 will impact one another at substantially the same time, the transition between the two stiffness regimes tends to relatively discrete, similar to what is depicted in FIG. 2A.

The threshold bend angle $\alpha_\tau$ at which shoe plate transitions between the stiffness regimes (i.e., initial/nominal stiffness to increased stiffness) is based on the width (x direction) and height (z direction) of recessed ridges 410, and the gap (size of channel 412) between recessed ridges 410. Threshold bend angle $\alpha_\tau$ increases with: an increase in that width thickness, a decrease in that height, and an increase in the size of the gap.

The stiffness of the greater-stiffness regime of shoe plate 401 is dictated by the composition (fiber type, resin type, fiber alignment, and fiber volume fraction) of recessed ridges 410, the width and to a lesser extent, the height of recessed ridges 410. The greater the degree of alignment of the fibers in recessed ridges 410 with the bending direction (i.e., along the longitudinal axis of the shoe plate), the greater the stiffness (i.e., more resistance to bending) resulting from the recessed ridges.

Figure 4C:
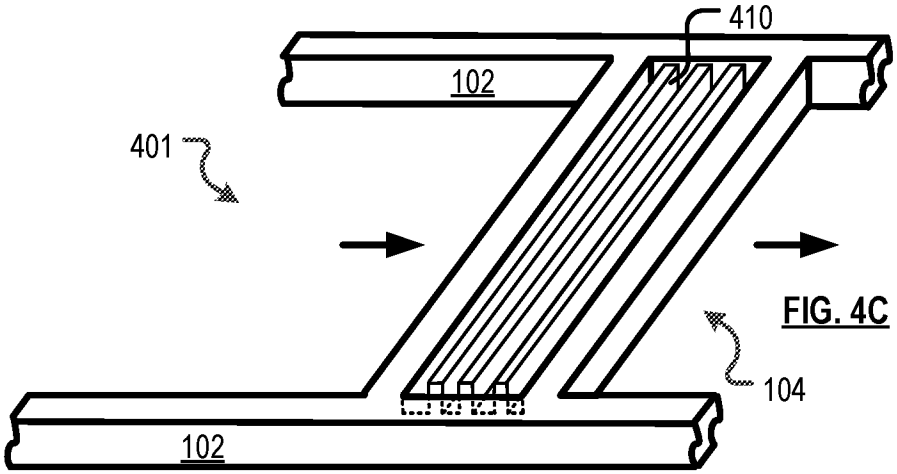
FIG. 4C depicts a perspective view of a modification of the shoe plate of FIG. 4A.

FIG. 4C depicts a perspective view of the portion of shoe plate 301 depicted in FIG. 4A, but somewhat modified. Specifically, in FIG. 4A, recessed ridges 410 are also present in perimeter rib 102. But in the embodiment depicted in FIG. 4C, recessed ridges 410 are restricted to internal rib 104. Shoe plate 301 of FIGS. 3A-3C can be modified in the same manner. In embodiments in which recessed ridges 410 are restricted to internal rib 104, the recessed ridges must not physically couple to, nor be immobilized by, the (inward-facing surface of) perimeter rib 102, since the recessed ridges must be free to move, etc., once threshold bending is achieved.

For both shoe plate 301 and shoe plate 401, typical dimensions for ridges 310, 410 are: height (z-direction in FIG. 3A): in a range of about 0.5 to about 2.5 mm; width (x-direction in FIG. 3A): in a range of about 1 to about 5 mm. The width of channel 312, 412 is in a range of about 0.5 to about 3 mm.

Figure 5A:
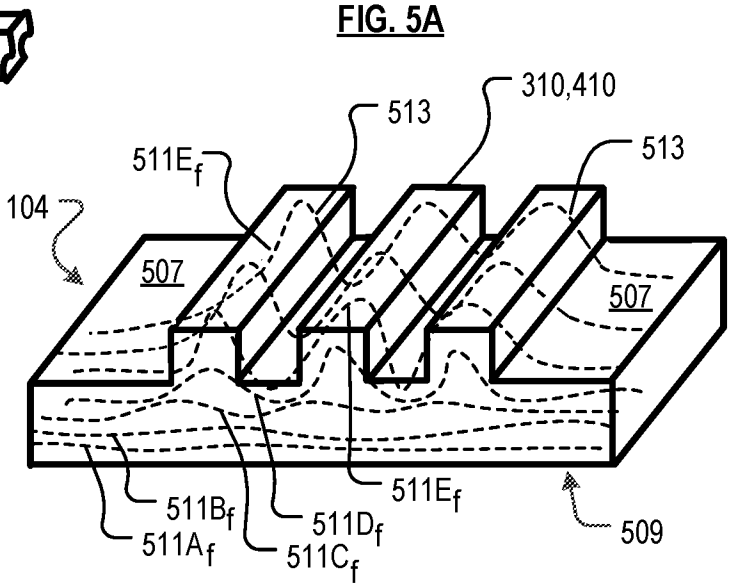
FIG. 5A depicts a portion of rib 104 of FIGS. 3C and 4C, showing fiber alignment therein.

FIG. 5A depicts an enlargement of a portion of rib 104, showing ridges disposed thereon, and the alignment of fibers therein. This figure is representative of embodiments of ridges 310 of shoe plate 301, as well as recessed ridges 410 of shoe plate 401.

In the illustrative embodiment, the fibers within rib 104 of shoe plates 301 and 401 are aligned with the longitudinal axis of the shoe plate (see arrows in FIGS. 3C and 4C, which indicate fiber direction). Consider that ridges 310 and recessed ridges 410 are relatively narrow (i.e., width in the range of about 1 to about 5 mm). Consequently, it is problematic to create an arrangement of fiber-bundle-preforms that reliably results in the fibers therefrom adopting, upon compression molding, the desired alignment in ridges 310, 410. As such, in some embodiments, rib 104 consists of fibers that are continuous with respect to the width (x-direction in FIG. 3A) of rib 104; in other words, the fibers have a length that is about equal to the width of rib 104. This is depicted in FIG. 5A, wherein fibers 511 span the width of rib 104.

Figure 5B:
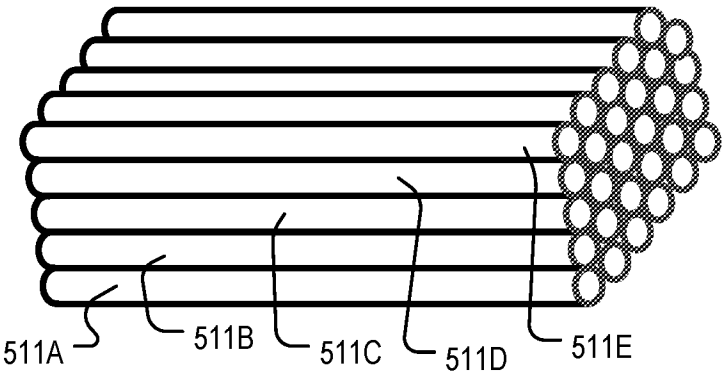
FIG. 5B depicts an arrangement of fiber-bundle-preforms for forming the rib depicted in FIG. 5A.

It is to be understood that there will be many thousands of fibers in rib 104; for clarity of illustration, only a few of such fibers are depicted. To fabricate a shoe plate that incorporates this embodiment of ridge-bearing rib 104, an assemblage of fiber-bundle-preforms (either a layup of loose preforms or a preform charge of "tacked" preforms) is created. A region of the assemblage includes a plurality of fiber-bundle-based preforms, such as depicted in FIG. 5B, wherein those preforms are appropriately aligned (as placed in a suitable compression mold), to fabricate rib 104 and ridges 310 or 410. Specifically, with respect to the embodiments being discussed, as positioned in the mold cavity, the long axis of the fiber-bundle-based preforms aligns with the arrows in FIGS. 3C and 4C.

The plurality of fiber-bundle-based preforms depicted in FIG. 5B includes (for illustrative purposes) five layers of preforms, including preforms 511A through 511E, each layer having multiple instances of the preforms. Referring now to FIGS. 5A and 5B, the position of the preforms in the stack is indicative of the final location of the fibers sourced from those preforms. For example, preforms 511A are the source of fibers 511$A_f$ that will be proximate to bottom surface 509 of rib 104, and preforms 511E are the source of fibers 511$E_f$ that will be proximate to top surface 507 of rib 104.

Due to the pressure gradients arising in the compression mold cavity during the compression-molding process, a portion 513 of each of some fibers 511$E_f$ proximate to upper surface 507 of rib 104 is drawn into ridges 310, 410, as depicted in FIG. 5A. In some embodiments, vents are fluidically coupled to the surface of the mold cavity at the location at which ridges 310, 410 are to be formed. Activating (i.e., opening) the vents creates a localized pressure gradient at that region to facilitate the movement of portion 513 of each of some of fibers 511$E_f$ into what will become ridges 310, 410. In this fashion, the desired fiber alignment is achieved, notwithstanding the very small feature size of ridges 310, 410.

Figure 6:
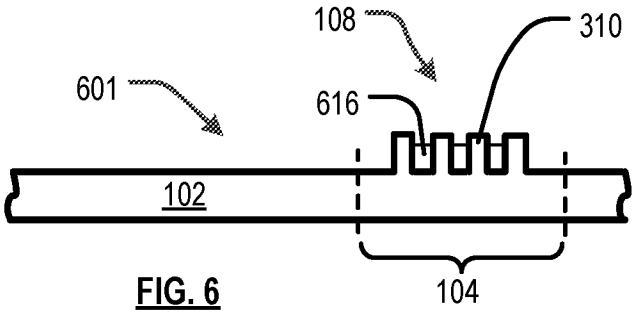
FIG. 6 depicts a side view of a portion of a shoe plate in accordance with FIG. 1A, the shoe plate having a physical adaption that provides a PLBS characteristic, wherein the shoe plate is shown in an undeflected state.

FIG. 6 depicts a portion of shoe plate 601 in accordance with the present teachings. Shoe plate 601 is a modification of shoe plate 301 of FIGS. 3A-3C (shoe plate 401 may be modified in similar fashion).

In this embodiment, material 616 is situated in channels between ridges 310. In some embodiments, material 616 is a solid foam. In such embodiments, the shoe plate will exhibit a more gradual transition between the two stiffness regimes, such as depicted in FIG. 2B. The solid foam has a lower density than the composite material (i.e., resin matrix and fibers) forming the ridges, and has a cellular structure in which cell walls are formed from a polymer, with air in the cells.

Ridges 310 will interfere with one another as previously described, but the initial resistance experienced upon threshold bending results from compressing the foam, rather than physical contact between ridges 310 (or recessed ridges 410). More particularly, as shoe plate 601 bends and ridges 310 are forced towards one another, air is squeezed out of the cells of the foam, increasing the compressive stiffness of the foam. Ultimately, the foam's "compressed density" approaches that of the cellular polymer (i.e., with substantially no air in cells, the foam becomes mostly polymer). As air is increasingly squeezed out, the stiffness will gradually increase, as depicted by the transitional region in FIG. 2B. Such an embodiment thus exhibits a somewhat more gradual transition to the greater-stiffness regime of the shoe plate.

In this embodiment, like that of embodiment of FIGS. 3A-3C, a layer of solid foam (not depicted) is present on perimeter rib 102 and all internal ribs, for the reason previously discussed.

Figure 7B:
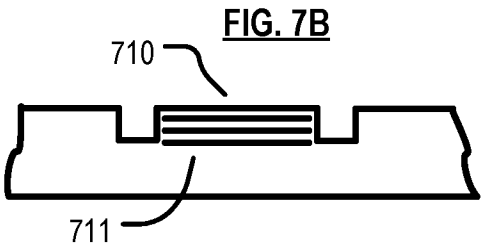
FIG. 7B depicts an enlargement of the portion of the shoe plate of FIG. 7A, showing fiber alignment in the physical adaptation that provides the PBLS characteristic.
Figure 7A:
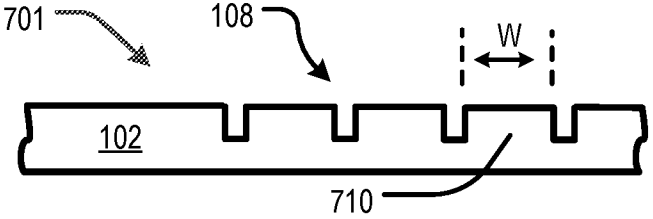
FIG. 7A depicts a side view of a portion of a shoe plate in accordance with FIG. 1A, the shoe plate having a physical adaption that provides a PLBS characteristic, wherein the shoe plate is shown in an undeflected state.

FIG. 7A depicts a side view of a portion of shoe plate 701 in accordance with the present teachings. In this embodiment, (recessed) ridges 710 are wider than recessed ridges 410 of FIGS. 4A-4C. Ridges 710 have a width, W, in a range of about 5 to about 7 mm. As depicted in FIG. 7B, the greater width of ridges 710 permits the placement of preforms 711, with a desired alignment, in the region of mold cavity that forms those ridges. This is in contrast to relying on pressure gradients to flow portions of continuous fibers into the ridges, as depicted in FIG. 5A. As a result of the "in-ridge" preform placement, the fiber volume fraction (FVF), and hence stiffness, of recessed ridges 710 is expected to be greater than the FVF of ridges 310 or 410. It is notable that the relatively thinner (x-axis in FIG. 3A) ridges, whether recessed or not, will experience less stress at their base (where they connect to underlying rib) than relatively wider ridges. Thus, the determination of a desired width for the ridges may be a balance between stress optimization and manufacturability. Such a determination is within the capabilities of those skilled in the art.

Figure 8:
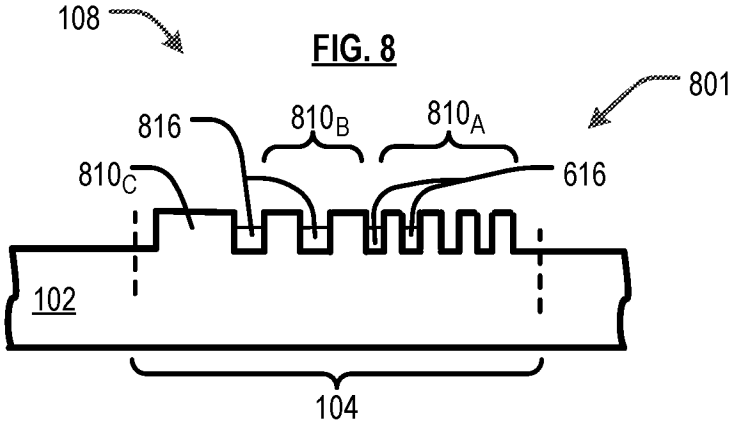
FIG. 8 depicts a side view of a portion of a shoe plate in accordance with FIG. 1A the shoe plate having a physical adaption that provides a PLBS characteristic, wherein the shoe plate is shown in an undeflected state.

FIG. 8 depicts a side view of a portion of shoe plate 801 in accordance with the present teachings. In this embodiment, physical adaptation 108 for providing the PLBS characteristic includes ridges 810A, 810B, and 810*c* of various widths, different sized gaps between the ridges, and two different types foam 616 and 816 having different density. At threshold bending, this will result in the stiffness increasing in non-linear fashion, as depicted in FIG. 2C.

FIGS. 9A through 9D depict shoe plate 901, which is another embodiment of a shoe plate that utilizes structural interference to create a PLBS characteristic.

Figures 9A, 9B, 9C, 9D:
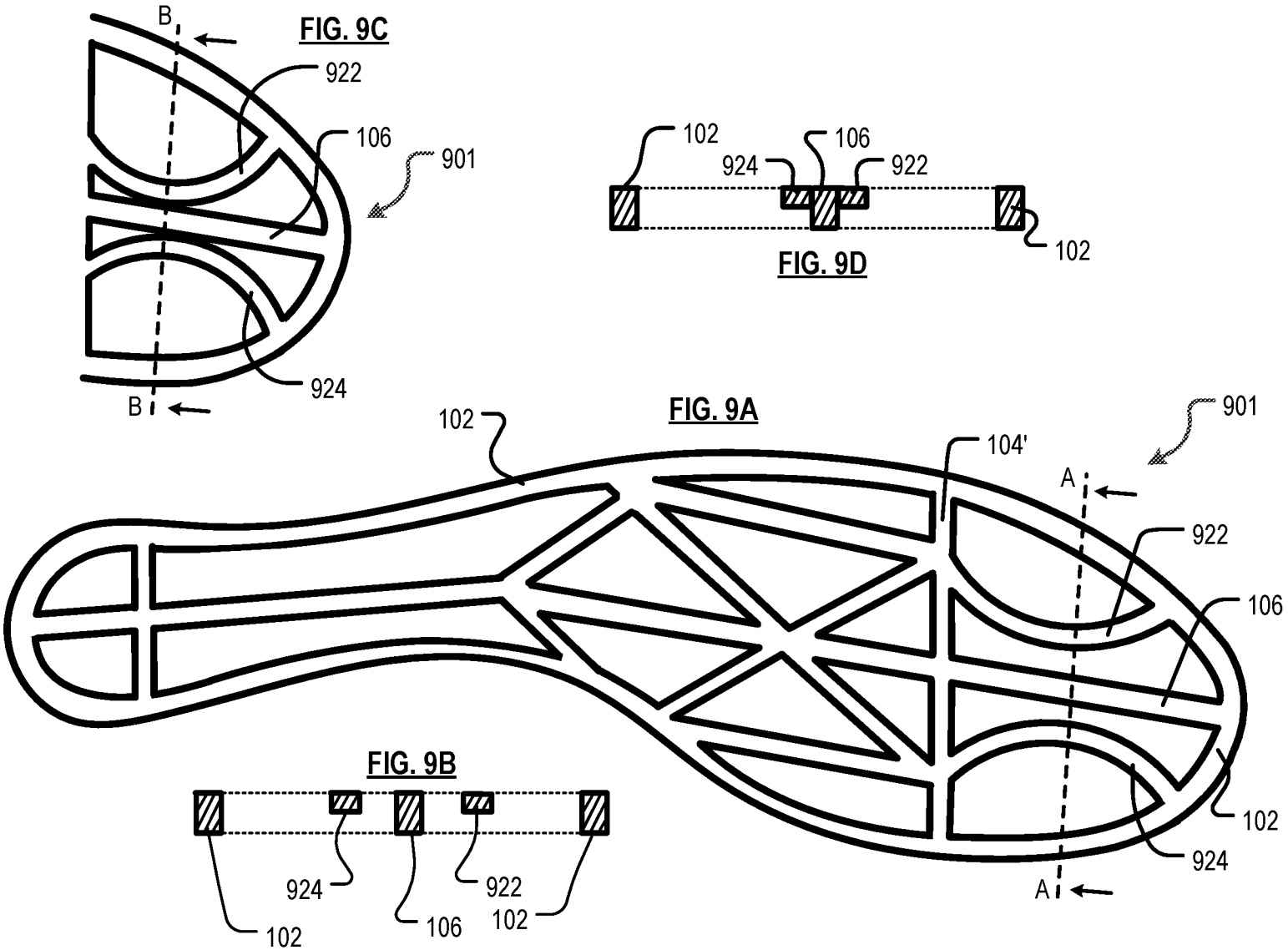
FIG. 9A depicts a shoe plate in accordance with FIG. 1A, the shoe plate having a physical adaption that provides a PBLS characteristic, the shoe plate shown in an undeflected state.
FIG. 9B depicts a sectional view, along the axis A-A in the direction shown, of the shoe plate of FIG. 9A (undeflected state).
FIG. 9C depicts a portion of the shoe plate of FIG. 9A, the portion of the shoe plate shown at threshold deflection.
FIG. 9D depicts a sectional view, along the axis B-B in the direction shown, of the shoe plate of FIG. 9C (threshold deflection).

Referring to FIG. 9A, shoe plate 901 includes perimeter rib 102, and a plurality of internal ribs, such as rib 104', rib 106, and ribs 922 and 924. Ribs 922 and 924 have a curved form. Each of ribs 922 and 924 is coupled, at one end thereof, to rib 104', and at its other end, to perimeter rib 102 at the front of shoe plate 901. An axis aligning with the ends of rib 922 and an axis aligning with the ends of rib 924 align with the bending direction (i.e., the longitudinal axis) of shoe plate 901. As depicted via the sectional view of FIG. 9B, ribs 922 and 924 have a thickness that is about half the thickness of perimeter rib 102 and rib 106. In the illustrative embodiment, ribs 922 and 924 are situated proximate to the upper surface of shoe plate.

FIG. 9C depicts shoe plate 901 at threshold bending. As shoe plate 901 bends (forward of rib 104'), the linear distance between the point of bending (i.e., proximate to rib 104') and the front of the shoe plate decreases. Of course, the length of the surface of shoe plate 901 does not change. However, the decrease in the linear distance between the bending location and the front of shoe plate 901 causes ribs 922 and 924, which are bent towards one another, to displace in the direction in which they are bent. As such, these will move towards one another, eventually rib 106, as depicted in FIG. 9C and the sectional view of FIG. 9D. Such contact will inhibit further displacement of ribs 922 and 924, effectively increasing the stiffness of shoe plate 901.

In some embodiments, to facilitate the strain of ribs 922 and 924, TPU (thermoplastic polyurethane) resin is used as the resin, rather than nylon or polycarbonate, either of which are typically used as the resin in the preforms that form other ribs in shoe plate 901. In addition to adding compliance to ribs 922 and 924, the increased strain-to-failure of TPU ensures that these ribs will not fail when subjected to repeated cycles of bending.

As previously noted, a shoe plate in accordance with the present teachings is incorporated into footwear, typically the mid-sole thereof. As such, there will be material, such as foam, directly above and below shoe plate 901. It is important that other than at their ends, where they connect to internal rib 104' and perimeter rib 102, ribs 922 and 924 must not connect to foam or, more generally, any other layer of the footwear. This ensures that the regions between the ends of ribs 922 and 924 move independently of other elements of shoe plate 901.

In some other embodiments, internal ribs are organized in a different geometry than depicted in FIGS. 9A-9D that also facilitates structural interference at a threshold level of bending. For example, in an embodiment in which rib 106 is not present, or has a reduced thickness and is positioned proximate to the bottom surface of shoe late 901, ribs 922 and 924 may contact one another at threshold bending. In light of the present disclosure, those skilled in the art will be able to design many arrangements that enable the ribs to abut other ribs, or one another, or some other structure, at a desired threshold amount of bending of the shoe plate.

The progressive stiffness behavior of shoe plates 301, 401, 501, 601, 701, 801, and 901 is due to structural interference between portions of the shoe plate. In some further embodiments, the anisotropic characteristics of the fiber composite material used to make the shoe plate is leveraged to create the progressive longitudinal bending stiffness characteristic.

Anisotropic Properties of Composites

Figures 10, 11A, 11B, 11C:
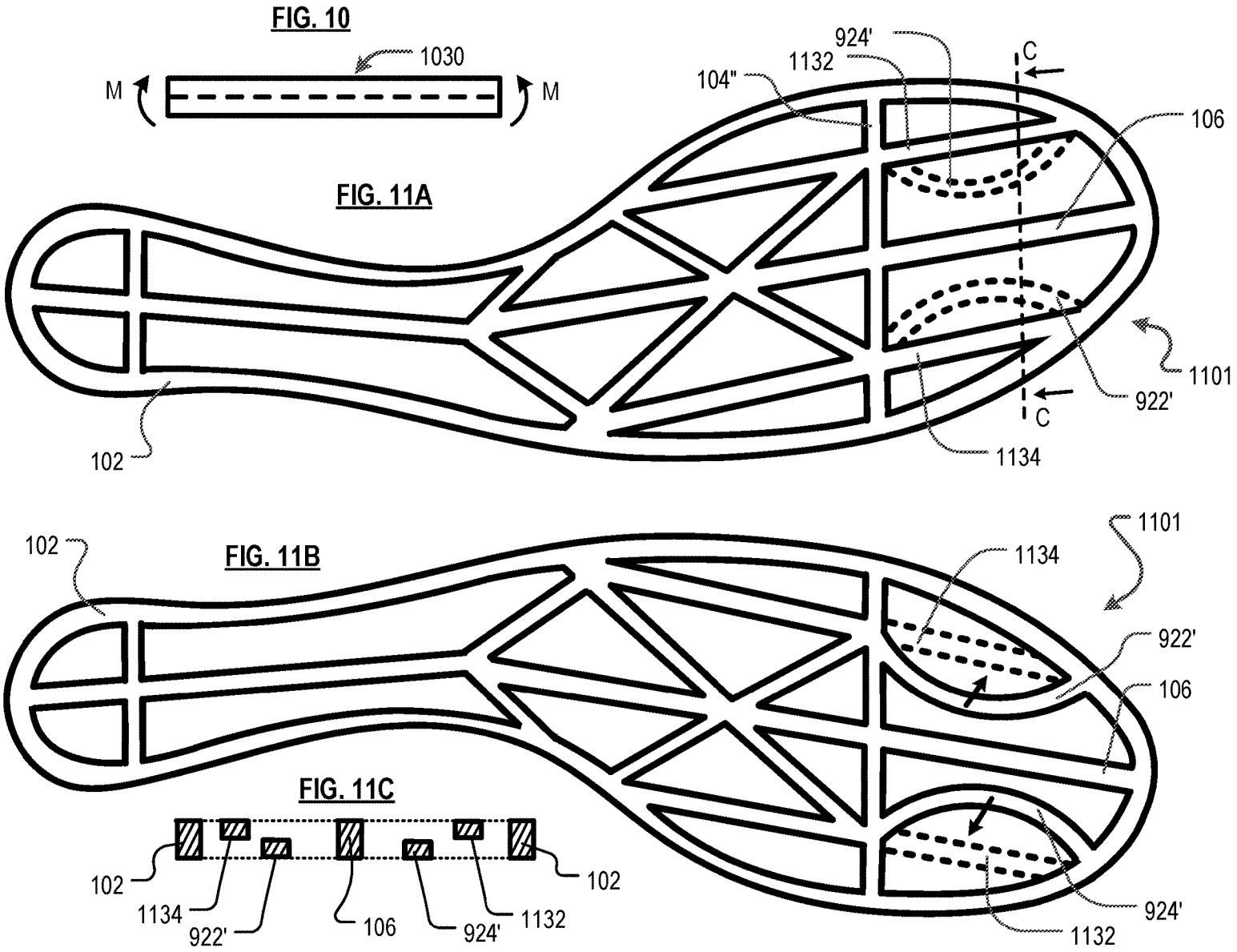
FIG. 10 depicts a conventional beam experiencing an upward bending moment.
FIG. 11A depicts a shoe plate in accordance with FIG. 1A, the shoe plate having a physical adaption that provides a PLBS characteristic, wherein the shoe plate is shown in an undeflected state, and wherein the figure provides a view of a first major surface of the shoe plate.
FIG. 11B depicts the shoe plate of FIG. 11A, showing a second major surface thereof.
FIG. 11C depicts sectional view along the axis C-C in the direction shown, of the shoe plate of FIG. 11A (undeflected state).

FIG. 10 depicts beam 1030, to which an upward bending moment is applied. As the beam bends upwards (not depicted), upper layer (upper half) of beam 1030 is in compression, and lower layer (or bottom half) of the beam 1030 is in tension. This concept is used to create a shoe plate that provides a PLBS characteristic, such as for shoe plate 1101 depicted in FIGS. 11A through 11C.

FIG. 11A depicts a view of upper surface (as positioned in footwear) of shoe plate 1101, and FIG. 11B depicts a view of the lower surface of shoe plate 1001. FIG. 11C depicts a sectional view of shoe plate 1101 along axis C-C of FIG. 11A in the direction indicated.

Linear ribs 1132, 1134, and 106 are disposed proximal to the upper surface of shoe plate 1101. Curved ribs 924' and 922' are disposed proximal to the lower surface of shoe plate 1101. Ribs 924' and 922' are fixed only at their ends; the region between the ends of these ribs must be free to move independently of surrounding material, etc.

Per the description accompanying FIG. 10, the upper half of shoe plate 1101 is in compression during bending, whereas the lower half of the shoe plate is in tension.

The fibers of linear ribs 1132, 1134, and 106, which are co-aligned with and continuous along the length of these ribs, align with the compressive stress experienced in the upper portion of shoe plate 1101. Fibers, such as those in ribs 1132, 1134, and 106 provide considerable bending stiffness due to their alignment with the prevailing force vectors.

When shoe plate 1101 is an unflexed (unbent) state, the fibers in curved ribs 924' and 922', which are co-aligned and continuous along the length of these ribs, will impart significantly less stiffness to the lower portion of shoe plate 1101 (than do linear ribs 106, 1132 and 1134). This is because ribs 924' and 922', and their fibers, are "off axis" with respect to the length axis of shoe plate 1101 and prevailing force vectors therein. As it bends, the lower half of shoe plate 1101 stretches due to tension, causing initially curved ribs 924' and 922' to straighten (deflecting in the direction of the arrows in FIG. 11B). As this occurs, ribs 924', 922' (and their fibers), move into alignment with the force-loading direction and, hence, the prevailing force vectors. This increases the effective modulus of ribs 924' and 922', thereby increasing the stiffness of shoe plate 1101. In other words, whereas shoe plate 1101 has only a portion of the fibers in the ribs aligned with the force loading direction prior to threshold bending, it has all of the fibers in the ribs substantially aligned with the force loading direction at threshold bending. This provides the PLBS characteristic, in accordance with the present teachings.

Bulk Modulus. In some embodiments, the PLBS characteristic of a shoe plate is implemented via an arrangement relying on material properties to create a change in the stiffness at threshold bending.

Returning to FIG. 6, in shoe plate 601, material 616 is a solid foam that ultimately collapses and thus does not prevent ridges 310 from structurally interfering with one another. In a further embodiment, the material within channels between ridges 310 or between recessed ridges 410 is a rubber having a bulk modulus that varies as a function of compressive load. The material prevents the ridges from contacting one another even at threshold bending. Rather, the increased resistance to further bending experienced at threshold bending is due to the bulk modulus of the material.

It is to be understood that the disclosure describes a few embodiments and that many variations of the invention can easily be devised by those skilled in the art after reading this disclosure and that the scope of the present invention is to be determined by the following claims.

What is claimed:

1. An article comprising a shoe plate, wherein the shoe plate is an open-lattice structure defined by a first plurality of ribs, and wherein the shoe plate consists essentially of a resin and fibers, and wherein the shoe plate has physical adaptation that provides a progressive longitudinal bending stiffness characteristic at a forefoot region of the shoe plate, wherein a stiffness of the shoe plate at the forefoot region increases at or above a threshold bend angle.

2. The article of claim 1 wherein the physical adaptation is a feature of the shoe plate that provides structural interference.

3. The article of claim 2 wherein the physical adaptation is a first rib of the plurality thereof, the first rib situated proximate to the forefoot region and having a plurality of ridges.

4. The article of claim 3 wherein at or above the threshold bend angle, adjacent ridges of the plurality contact one another.

5. The article of claim 4 wherein the threshold bend angle is an angle that is in a range of between about 10 degrees and 60 degrees.

6. The article of claim 3 wherein the first rib has a transverse orientation in the shoe plate, wherein an axis aligned with a longest dimension of the first rib is substantially perpendicular to a bending direction of the forefoot region of the shoe plate.

7. The article of claim 6 wherein fibers within the first rib and the plurality of ridges are substantially aligned with the bending direction of the shoe plate.

8. The article of claim 3 wherein a solid foam is disposed between the ridges.

9. The article of claim 2 wherein the first plurality of ribs includes a perimeter rib and first rib proximate to the forefoot region of the shoe plate, the first rib having a transverse orientation, the physical adaptation comprising at least two curved ribs that are located within the forefoot region of the shoe plate, wherein each of the curved ribs is coupled to the shoe plate only at ends of the curved ribs so that the curved ribs, at other than their respective ends, are free to deflect when the shoe plate bends at the forefoot region.

10. The article of claim 9 wherein the two curved ribs are coupled to the shoe plate proximate to an upper surface thereof, so that when the shoe plate bends, the two curved ribs deflect towards one another.

11. The article of claim 9 wherein the two curved ribs are coupled to the shoe plate proximate to a lower surface thereof and configured so that at or above the threshold bend angle, the two curved ribs deflect so as to reduce a curvature thereof to an extent that fibers within said ribs are substantially aligned with a longitudinal axis of the shoe plate.

12. The article of claim 1 wherein the article is a mid-sole of footwear.

13. The article of claim 1 wherein the article is footwear.

14. An article comprising a shoe plate, wherein the shoe plate is an open-lattice structure defined by a plurality of ribs, including a first rib having a plurality of ridges and located proximate to a forefoot region of the shoe plate, wherein the ridges are configured so that below a threshold bend angle, at least a free end of each ridge does not contact an adjacent ridge, and at or above the threshold bend angle, the free end of each ridge contacts the adjacent ridge, the ridges thus providing a progressive longitudinal bending stiffness characteristic at a forefoot region of the shoe plate, wherein a stiffness of the shoe plate at the forefoot region increases at or above the threshold bend angle.

15. The article of claim 14 wherein the first rib has a transverse orientation in the shoe plate, wherein an axis aligned with a longest dimension of the first rib is substantially perpendicular to a bending direction of the forefoot region of the shoe plate.

16. The article of claim 14 wherein the ridges extend upwardly from an upper surface of the first rib.

17. The article of claim 14 wherein the ridges are disposed within the first rib.

* * * * *